US011297937B1

(12) United States Patent
Gelman et al.

(10) Patent No.: US 11,297,937 B1
(45) Date of Patent: Apr. 12, 2022

(54) COLLAPSIBLE BENCH AND COLLAPSIBLE BENCH KIT

(71) Applicant: E&T Horizons Limited Liability Company, Melbourne, FL (US)

(72) Inventors: Eric Gelman, Melbourne, FL (US); Jeffrey Moore, Melbourne, FL (US)

(73) Assignee: E&T HORIZONS LIMITED LIABILITY COMPANY, Melbourne, FL (US)

( * ) Notice: Subject to any disclaimer, the term of this patent is extended or adjusted under 35 U.S.C. 154(b) by 0 days.

(21) Appl. No.: 17/196,616

(22) Filed: Mar. 9, 2021

(51) Int. Cl.
*A47B 3/06* (2006.01)
*A47B 13/00* (2006.01)

(52) U.S. Cl.
CPC ..... *A47B 3/06* (2013.01); *A47B 13/003* (2013.01); *A47B 2230/0022* (2013.01); *A47B 2230/0074* (2013.01); *A47B 2230/0085* (2013.01)

(58) Field of Classification Search
CPC ..... A47B 3/06; A47B 3/12; A47B 13/003; A47B 2330/0022; A47B 2330/0074; A47B 2200/0002
See application file for complete search history.

(56) References Cited

U.S. PATENT DOCUMENTS

| | | | | | |
|---|---|---|---|---|---|
| 889,600 | A * | 6/1908 | Graumiller | A47B 3/12 | 108/101 |
| 3,869,993 | A * | 3/1975 | Edlund | A47B 3/06 | 108/101 |
| 4,559,877 | A * | 12/1985 | Waibel | A47B 17/033 | 108/64 |
| 5,943,968 | A * | 8/1999 | Dobson | A47B 87/002 | 108/124 |
| 5,983,420 | A * | 11/1999 | Tilley | A47B 13/02 | 108/91 |
| 2003/0205180 | A1* | 11/2003 | Bishop | A47B 13/003 | 108/158.12 |
| 2017/0156486 | A1* | 6/2017 | Blick | F16B 12/30 | |
| 2017/0164730 | A1* | 6/2017 | Lee | A47B 3/12 | |
| 2020/0146438 | A1* | 5/2020 | Choi | A47B 13/003 | |
| 2020/0260861 | A1* | 8/2020 | Wu | A47B 3/06 | |
| 2021/0018028 | A1* | 1/2021 | Hutson | A47B 13/003 | |
| 2021/0219711 | A1* | 7/2021 | Lai | F16B 12/44 | |

* cited by examiner

*Primary Examiner* — Daniel J Rohrhoff
(74) *Attorney, Agent, or Firm* — Mark Malek; Widerman Malek, PL

(57) ABSTRACT

A collapsible bench according to the present invention includes a bottom member having a leg extending downwardly from a bottom portion thereof, and a first side member that is detachably connectable to a first side portion of the bottom member. The collapsible bench also includes a second side member that is detachably connected to a second side portion of the bottom member, and a lateral support member that is detachably connectable to the first side member and the second side member. The collapsible bench further includes a top member that is detachably connectable to the lateral support member. The top member and the bottom member have substantially the same shape.

20 Claims, 5 Drawing Sheets

COLLAPSIBLE BENCH AND COLLAPSIBLE BENCH KIT

FIELD OF THE INVENTION

The present invention relates to furniture and, more specifically, to a collapsible bench and a collapsible bench kit.

BACKGROUND OF THE INVENTION

Furniture can be bulky in nature and can be difficult and expensive to ship. In some cases, retailers have shipped disassembled furniture in flat boxes. This can save on shipping costs, as well as inventory space for retailers. As anyone that has ever tried to assemble furniture can likely attest, assembling furniture can prove to be a difficult task, and more often than not, directions that come with furniture to be assembled can be unclear.

For example, US Patent Application Publication No. 2008/0074014 by Ho discloses a collapsible desk that includes several individual pieces. More specifically, the desk requires that a user align and piece together many different elements. This can prove to be complicated in nature and require more than one person assemble such furniture.

Also for example, US Patent Application Publication No. 2008/0246376 by Krieger also discloses furniture that requires assembly. Similar to the example above, the bookcase disclosed in the Krieger '376 patent application requires careful alignment of Several components in order to achieve assembly of the bookcase. Further, assembly of this type of furniture would also require multiple persons to effectively complete.

Further, U.S. Pat. No. 4,421,366 to Niziol discloses furniture that requires self-assembly. The furniture in the Niziol '366 patent requires the use and alignment of angled fasteners in order to assemble the furniture. Again, this kind of furniture assembly can be difficult and can require more than the two hands that are normally available on one person.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a collapsible bench that includes a bottom member having a leg extending downwardly from a bottom portion thereof. The collapsible bench also includes a first side member that is detachably connected to a first side portion of the bottom member. The collapsible bench according to embodiments of the present invention may also include a second side member that is detachably connected to a second side portion of the bottom member. The collapsible bench may still further include a lateral support member that is detachably connectable to the first side member and the second side member. The collapsible bench may also include a top member that is detachably connectable to the lateral support member. The top member and the bottom member may have substantially the same shape.

The first side member may be defined by a top and a pair of leas that connect to and extend downwardly from the top.

The pair of legs may be sized to have a length so that a bottom of the pair of legs extends to a distance similar to a bottom of the leg that extends downwardly from the bottom member. The second side member may be defined by a single leg that is sized to have a length so that a bottom of the single leg extends to a distance similar to a bottom of the leg that extends downwardly from the bottom member.

The lateral support member may be defined by a first end and a second end. The first and second ends may include connection members that extend outwardly therefrom. The first side member may include a first connection member receiving slot formed therein. The second side member may include a second connection member receiving slot formed therein. The connection members on the first end and the second end of the lateral support member may be configured to meet with the first connection member receiving slot and the second connection member receiving slot to connect the lateral support member to the first side member and the second side member.

The collapsible bench according to embodiments of the present invention may include a plurality of fasteners. More specifically, the plurality of fasteners may include a first fastener that is configured to extend through a portion of the first side member and into the bottom member. The plurality of fasteners my also include a second fastener configured to extend through another portion of the first side member and into the bottom member. A third fastener may also be provided that is configured to extend through the second side member and into the bottom member. A fourth fastener may be provided that is configured to extend through the second side member and into the lateral support member. A fifth fastener may be provided that is configured to extend through the second side member and into the lateral support member. A sixth fastener may also be provided that is configured to extend through the lateral support member and into the top member. The plurality of fasteners may further include a seventh fastener that is configured to extend through the lateral support member and into the top member.

The first side member may be defined as having a pair of legs. The second side member may be defined by a single leg. The collapsible bench may further include floor contact members that are connected to bottom portions of the pair of legs of the first side member, the leg of the second side member, and the leg of the bottom member. The collapsible bench according to embodiments of the present invention may be moveable between a collapsed position and an assembled position. When in the collapsed position, the bottom member, the first side member, the second side member and the lateral support member can be configured in a substantially flat configuration.

Embodiments of the present invention are also directed to a collapsible bench kit. The collapsible bench kit may include a container, and a collapsible bench that is moveable between an assembled position and a collapsed position.

The collapsible bench may include a bottom member having a leg extending downwardly from the bottom portion thereof. The collapsible bench may also include a first side member that is detachably connectable to a first side portion of the bottom member. The collapsible bench may also include a second side member that is detachably connectable to a second side portion of the bottom member. The collapsible bench may further include a lateral support member that is detachably connectable to the first side member and the second side member, and a top member that is detachably connectable to the lateral support member.

The collapsible bench may also include a plurality of fasteners configured to connect the first side member to the bottom member, the second side member to the bottom member, and the top member to the lateral support member.

The assembled position is defined as the bottom member, the first side member, the second side member, the lateral support member, and the top member being connected to one another to form an assembled bench. The collapsed position may be defined as the bottom member, the first side member, the second side member, the lateral support member, and the top member being detached from one another and configurable in a substantially flat configuration. When the collapsible bench is in the collapsed position, each of the bottom member, the first side member, the second side member, the lateral support member, the top member, and the plurality of fasteners are positionable within the container.

DETAILED DESCRIPTION OF THE INVENTION

Figure 1:
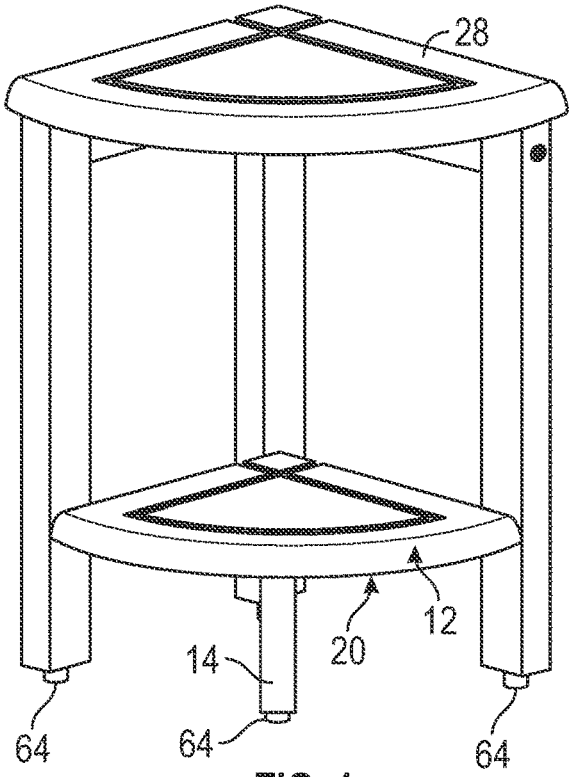
FIG. 1 is a front perspective view of a collapsible bench according to embodiments of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described in the various figures and accompanying text, provides a collapsible bench 10 that illustratively includes a bottom member 12 having a leg 14 that extends downwardly from a bottom portion 16 thereof. The collapsible bench 10 according to the present invention may also illustratively include a first side member 18. The first side member 18 is detachably connectable to a first side portion 20 of the bottom member 12. The collapsible bench 10 according to embodiments of the present invention may also include a second side member 22, which may be detachably connected to a second side portion 24 of the bottom member 12.

The collapsible bench 10 may also include a lateral support member 26. The lateral support member 26 may illustratively be detachably connected to the first side member 18 and the second side member 22. The collapsible bench may still further comprise a top member 28 that may be detachably connected to the lateral support member 26.

Figure 4:
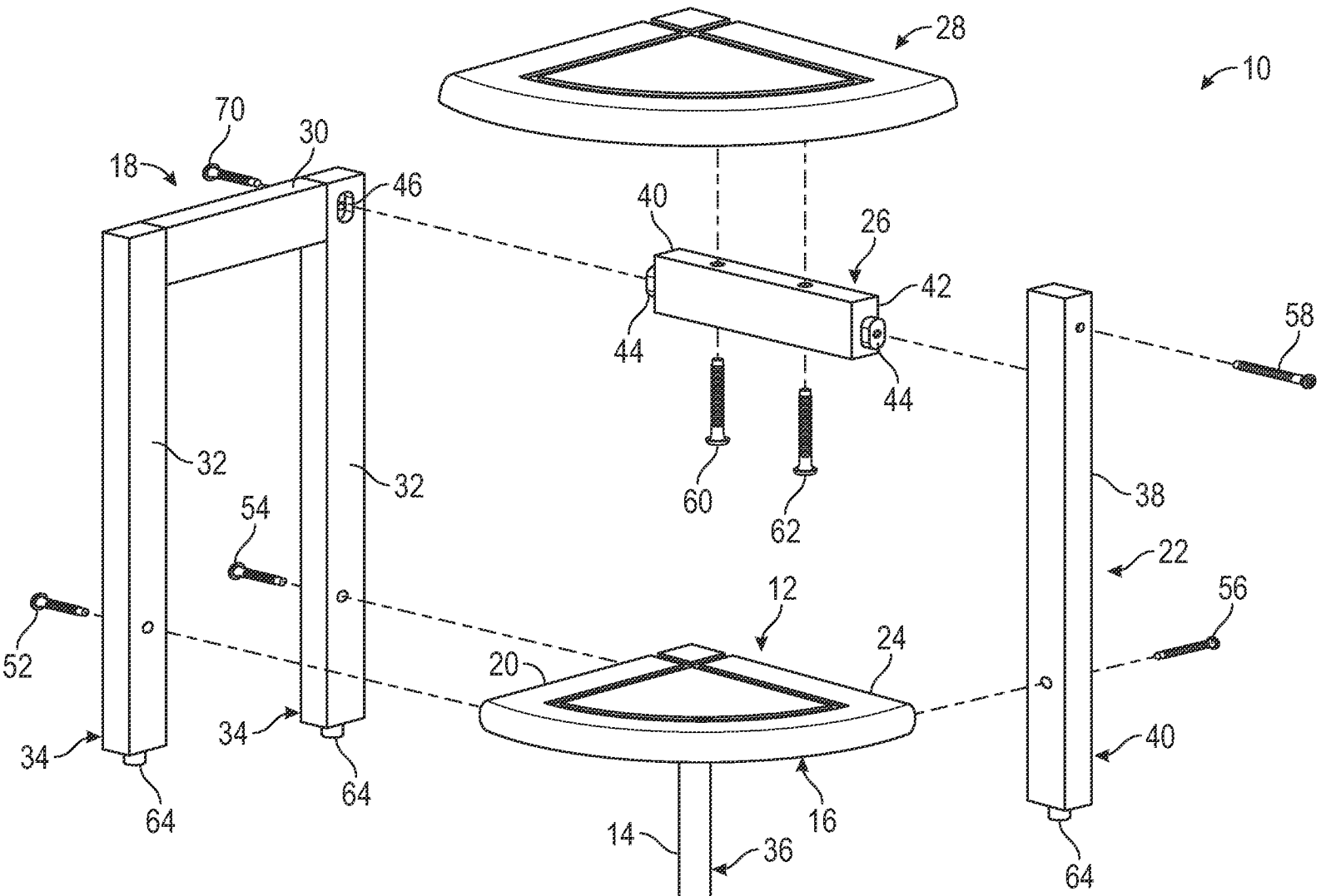
FIG. 4 is an exploded perspective view of the collapsible bench illustrated in FIG. 1.

As perhaps best illustrated in FIG. 4, the top member 28 and the bottom member 12 may have substantially the same shape. In the illustrated embodiment, the collapsible bench 10 is illustrated as a corner bench, i.e. a bench that is suitable for being positioned in a corner, i.e. a ninety-degree angle corner, so that a rear portion of the bench 10 is positioned to be in contact with, or in close proximity to, the walls that form the corner, and the curved portion of the bench is positioned outwardly. As such, both the top member 28 and the bottom member 12 include first and second sides that are straight and meet each other at a ninety-degree angle and are connected by an arching, or curved, outer surface. Those skilled in the art, however, will appreciate that the collapsible bench 10, as well as the bottom member 12 and the top member 28 may be provided by any shape, and that the shape of the collapsible bench 10 illustrated in the appended figures is not meant to limit the shape of the collapsible bench according to embodiments in the present invention. Further, those skilled in the art will appreciate that the collapsible bench 10 may have other shapes, i.e., a bottom member 12 and a top member 28 may have other shapes such as, for example, polygonal, circular, triangular, or any other type of shape, while still accomplishing the goals, features, and objectives according to the present invention.

Figure 2:
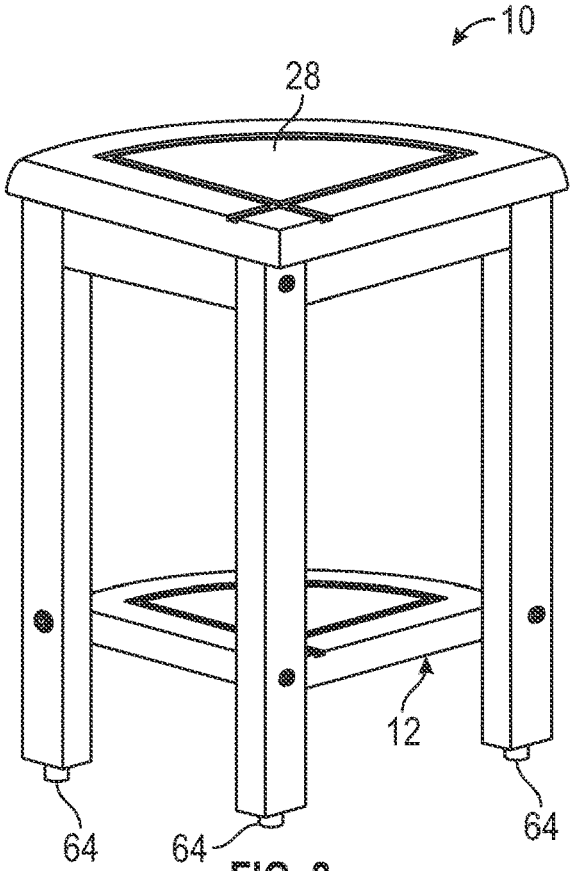
FIG. 2 is a rear perspective view of the collapsible bench illustrated in FIG.
Figure 3:
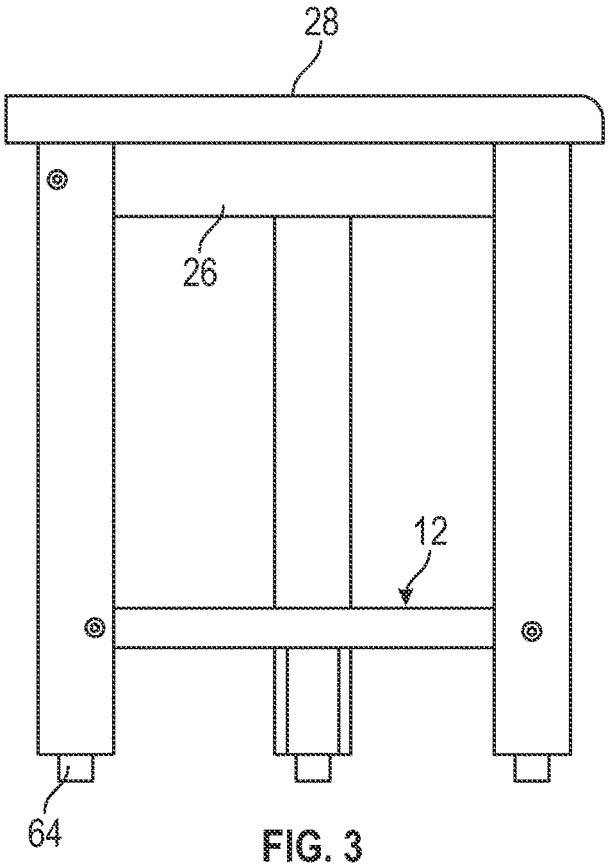
FIG. 3 is a side elevation view of the collapsible bench illustrated in FIG. 1.

As perhaps best illustrated in FIGS. 1, 2, and 3, the first side member 18 of the collapsible bench 10 according to embodiments of the present invention may be defined by a top 30 and a pair of legs 32 that connect to and extend downwardly from the top. The pair of legs 32 are preferably sized to having length so that a bottom 34 of each of the pair of legs 32 extends to a distance similar to a bottom 36 of the leg 14 that extends downwardly from the bottom member 12. Further, the second side member 22 may be defined by a single lea 38 that is sized to having length so that a bottom 40 of the single leg 38 extends to a distance similar to a bottom 36 of the leg 14 that extends downwardly from the bottom member 12.

The lateral support member 26 on the collapsible bench 10 according to embodiments of the present invention may be defined as having a first end 40 and a second end 42. More specifically, the lateral support member 26 is longitudinally positioned between the first side member 18 and the second side member 22. The lateral support member 26 preferably has a length that is substantially similar to the second side portion 24 of the bottom member 12. As perhaps best illustrated in FIG. 4, the lateral support member 26 is spaced apart from and positioned in substantial alignment with the second side portion 24 of the bottom member 12. The first and second ends 40, 42 of the lateral support member 26 may include connection members 44. The connection members 44 of the lateral support member 26 extend outwardly from the respective first end 40 and second end 42. The connection members 44 are illustrated as having an ovular shape, but those having skill in the art will appreciate that the connection members 44 may have any shape while still carrying out the objects, features, and advantages according to the present invention.

The first side member 18 may include a first connection member receiving slot 46 formed therein. Further, the second side member 22 may include a second connection member receiving slot 48 formed therein. The first connection member receiving slot 46 and second connection member receiving slot 48 are perhaps best illustrated in FIG. 5. The connection members 44 on the first end 40 and the second end 42 of the lateral support member 26 are configured to mate with the first connection member receiving slot 46 and the second connection member receiving slot 48 to connect the lateral support member 26 to the first side member 18 and the second side member 22. More specifically, the illustrated embodiment of the collapsible bench 10 according to the present invention showed the first connection member receiving slot 46 and the second connection member receiving slot 48 as having a substantially ovular shape. The first and second connection member receiving slots 46, 48, are so shaped in the illustrated embodiment to receive the connection members 44, which are similarly shaped. Further, the first and second connection member receiving slots 46, 48 are contemplated as having a size slightly larger than the size of each of the connection members 44 to allow for a mating connection between each of the connection members 44 and the first and second connection member receiving slot 46, 48. Those skilled in the art will appreciate that a first and second connection member receiving slots 46, 48, as well as the connection members 44 may have any other shape provided, however, that in any given embodiment of the collapsible bench 10, the shape of the first and second connection member receiving slots 46, 48 are substantially similar to the shape of the connection members 44.

Figure 5:
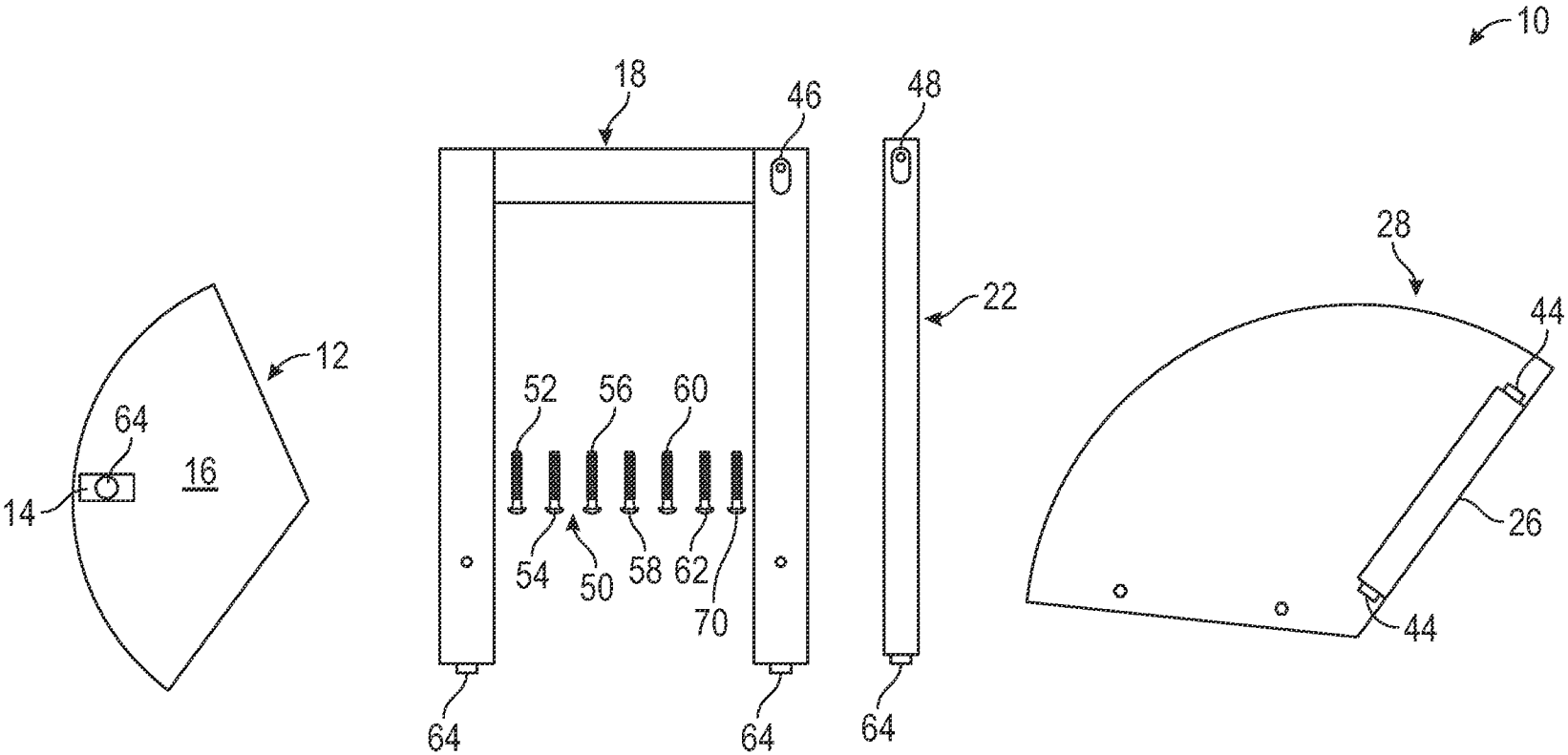
FIG. 5 is a view of the collapsible bench illustrated in FIG. 1 in the collapsed position and showing all components thereof.

As perhaps illustrated best in FIGS. 4 and 5, the collapsible bench 10 according to embodiments of the present invention may include a plurality of fasteners 50. More specifically, the plurality of fasteners 50 may include a first fastener 52 that is configured to extend through a portion of the first side member 18 and into the bottom member 12. The plurality of fasteners 50 may also include a second fastener 54 configured to extend through another portion of the first side member 18 and into the bottom member 12. The plurality of fasteners 50 may further include a third fastener 56 that is configured to extend through the second side member 22 and into the bottom member 12. The plurality of fasteners 50 may still further include a fourth fastener 58 that is configured to extend through the second side member 22 and into the lateral support member 26. The plurality of fasteners 50 may also include a fifth fastener 70 that is configured to extend through a top portion of the first side member 18 and into an opposing side of the lateral support member that the fourth fastener 58 is configured to connect to. The plurality of fasteners may further include a sixth fastener 60 that is configured to extend through the lateral support member 26 and into the top member 28. Finally, the plurality of fasteners 50 may include a seventh fastener 62 that is configured to extend through the lateral support member 26 and into the top member 28. The plurality of fasteners 50 are configured to pass through passageways formed in the first side member 18, the second side member 22, and the lateral support member 26. This is perhaps best illustrated in FIG. 4. Further; fastener member receiving passageways are formed in the bottom member 12, the lateral support member 26, and the top member 28.

The collapsible bench 10 according to embodiments of the present invention may also include floor contact members 64. The floor contact members 64 are connected to bottom portions of the pair of legs 32 of the first side member 18, the leg 38 of the second side member 22, and the leg 14 of the bottom member 12. Those skilled in the art will appreciate that the floor contact members 64 may be provided by a rubberized material, or other material that has properties to prevent the collapsible bench 10 from slipping or moving. For example, the floor contact members 64 may be provided by a rubber material to reduce or prevent slipping of the collapsible bench 10 when positioned on a hard and flat surface, e.g. a tile floor, a hardwood floor, a laminate floor, and any other type of flat surface that may allow for items having a low coefficient of friction to readily move.

Figure 6:
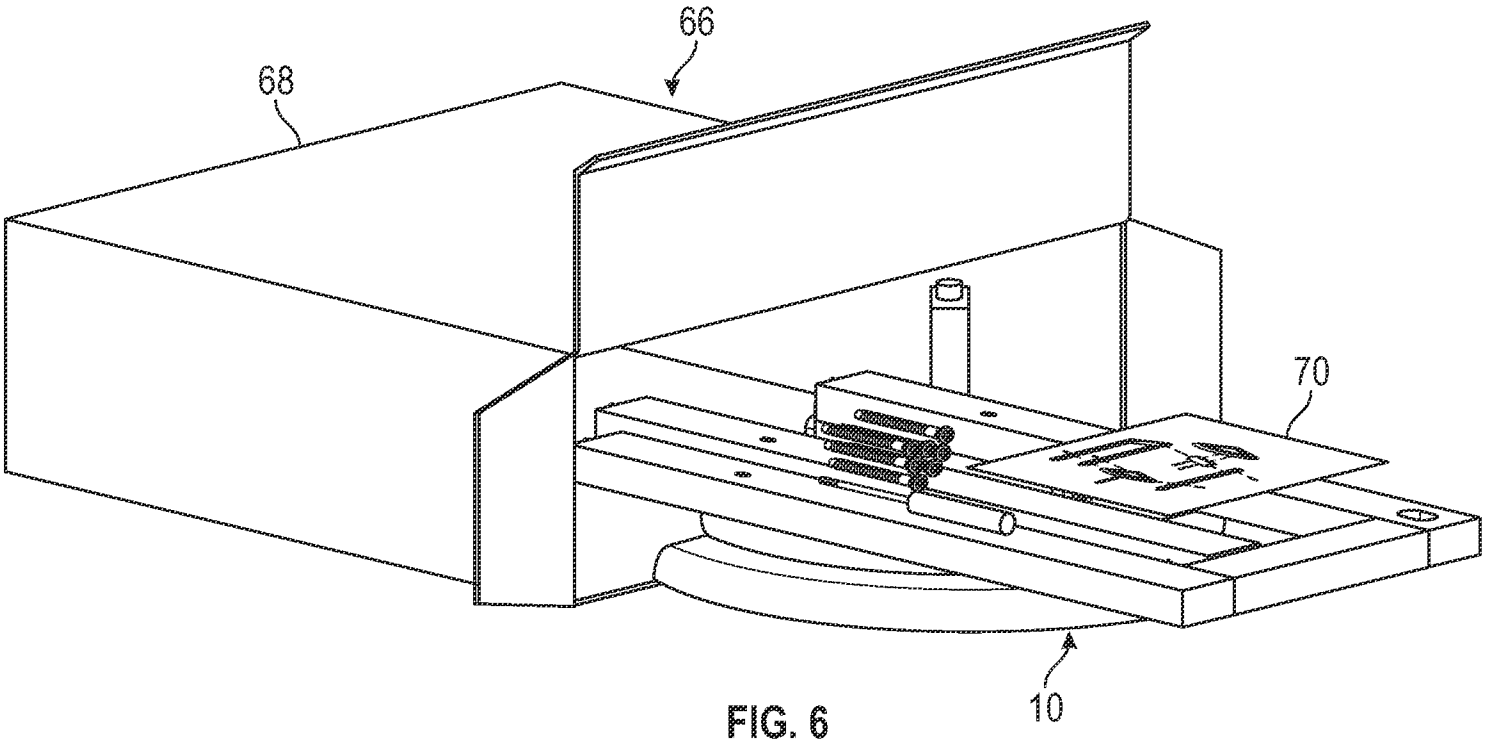
FIG. 6 is a perspective view of the collapsible bench kit according embodiments of the present invention.

As perhaps best illustrated in FIGS. 5 and 6, the collapsible bench can according to embodiments of the present invention is moveable between the collapsed position and an assembled position. When in the collapsed position, as perhaps best illustrated in FIG. 5, the bottom member 12, the first side member 18, the second side member 22, and the lateral support member 26 may be configured in a substantially flat configuration. When in the assembled position, as perhaps best illustrated in FIGS. 1, 2, and 3, the components of the collapsible bench 10 are connected to one another to form an assembled collapsible bench.

Referring now to FIG. 6, the collapsible bench kit 66 according to embodiments of the present invention is now described in greater detail. The collapsible bench kit 66 may include a container 68, and the collapsible bench 10 that has been described herein above. When the collapsible bench 10 is in the collapsed position, each of the bottom member 12, the first side member 18, the second side member 22, the lateral support member 26, the top member 28, and the plurality of fasteners 50 are position able within the container. The collapsible bench kit 66 according to embodiments of the present invention advantageously allows for the collapsible bench to be positioned within the container 68, so that a smaller sized container may be provided when shipping the collapsible bench, or when positioned in inventory at a retail location, or at a storage facility. This is advantageous in that the collapsible bench 10 according to embodiments of the present invention requires less room to be stored by a retailer, for example, and can be less costly to ship. The collapsible bench kit 66 may also include assembly instructions 70 that are positionable within the container 60. Those skilled in the art will appreciate that any other documentation, instructions, or other materials may also be included within the container 68 of the collapsible bench kit 66 according to embodiments of the present invention.

Figure 7:
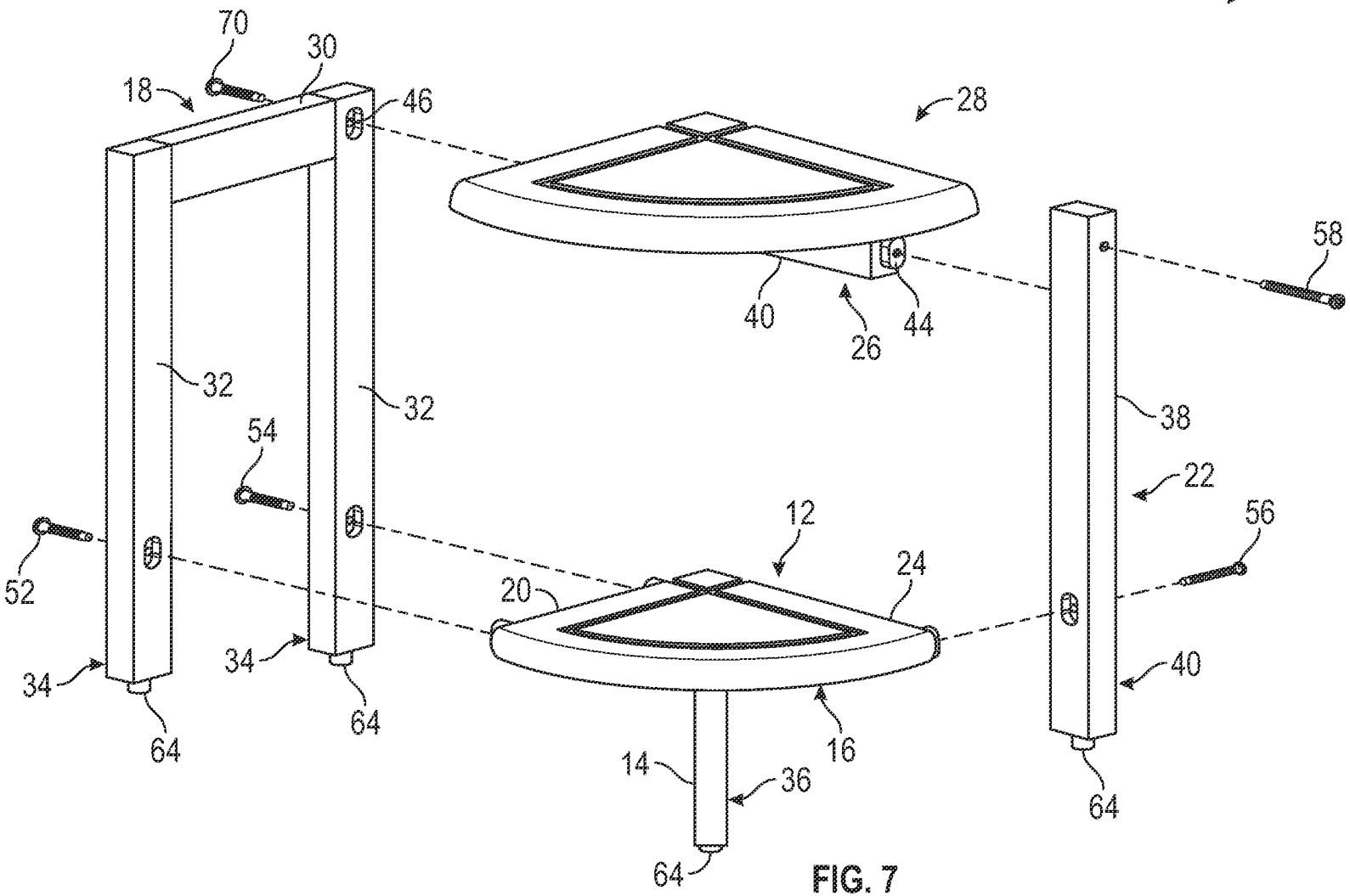
FIG. 7 is an exploded perspective view of the collapsible bench according to another embodiment of the present invention.

Referring now additionally to FIG. 7, another embodiment of the collapsible bench 10 according to the present invention is now described in greater detail. In this embodiment of the collapsible bench 10, the lateral support member 20 is connected to a bottom portion of the top member 28. Accordingly, in this embodiment of the invention, the lateral support member 20 is not detachably connected to the top member 28, but rather, the lateral support member 20 is fixedly connected to the top member 28. This advantageously reduces the number of fasteners required to assemble the collapsible bench 10 according to the present invention.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A collapsible bench comprising:

a bottom member having a leg extending downwardly from a bottom portion thereof;

a first side member that is detachably connectable to a first side portion of the bottom member;

a second side member that is detachably connectable to a second side portion of the bottom member;

a lateral support member that is detachably connectable to the first side member and the second side member; and a top member that is detachably connectable to the lateral support member;

wherein the top member and the bottom member have substantially the same shape.

2. The collapsible bench according to claim 1 wherein the first side member is defined by a top and a pair of legs that connect to and extend downwardly from the top; and wherein the pair of legs are sized to have a length so that a bottom of the pair of legs extends to a distance similar to a bottom of the leg that extends downwardly from the bottom member.

3. The collapsible bench according to claim 1 wherein the second side member is defined by a single leg that is sized to have a length so that a bottom of the single leg extends to a distance similar to a bottom of the leg that extends downwardly from the bottom member.

4. The collapsible bench according to claim 1 wherein the lateral support member is defined by a first end and a second end; and wherein the first and second ends include connection members that extend outwardly therefrom.

5. The collapsible bench according to claim 4 wherein the first side member includes a first connection member receiving slot formed therein; wherein the second side member includes a second connection member receiving slot formed therein; and wherein the connection members on the first end and the second end of the lateral support member are configured to mate with the first connection member receiving slot and the second connection member receiving slot to connect the lateral support member to the first side member and the second side member.

6. The collapsible bench according to claim 1 further comprising a plurality of fasteners.

7. The collapsible bench according to claim 6 wherein the plurality of fasteners comprise:

a first fastener configured to extend through a portion of the first side member and into the bottom member;

a second fastener configured to extend through another portion of the first side member and into the bottom member;

a third fastener that is configured to extend through the second side member and into the bottom member;

a fourth fastener that is configured to extend through the second side member and into the lateral support member;

a fifth fastener that is configured to extend through the first side member and into the lateral support member;

a sixth fastener that is configured to extend through the lateral support member and into the top member; and a seventh fastener that is configured to extend through the lateral support member and into the top member.

8. The collapsible bench according to claim 1 wherein the first side member is defined as having a pair of legs; wherein the second side member is defined by a single leg; and further comprising floor contact members that are connected to bottom portions of the pair of legs of the first side member, the leg of the second side member, and the leg of the bottom member.

9. The collapsible bench according to claim 1 wherein the bench is movable between a collapsed position and an assembled position; and wherein when in the collapsed position, the bottom member, the first side member, the second side member and the lateral support member can be configured in a substantially flat configuration.

10. A collapsible bench comprising:

a bottom member having a leg extending downwardly from a bottom portion thereof;

a first side member that is detachably connectable to a first side portion of the bottom member;

a second side member that is detachably connectable to a second side portion of the bottom member;

a top member having a lateral support member fixedly connected thereto, the lateral support member being detachably connectable to the first side member and the second side member; and wherein the first side member is defined by a top and a pair of legs that connect to and extend downwardly from the top;

wherein the pair of legs are sized to have a length so that a bottom of the pair of legs extends to a distance similar to a bottom of the leg that extends downwardly from the bottom member;

wherein the second side member is defined by a single leg that is sized to have a length so that a bottom of the single leg extends to a distance similar to a bottom of the leg that extends downwardly from the bottom member;

wherein the lateral support member is defined by a first end and a second end; and wherein the first and second ends include connection members that extend outwardly therefrom;

wherein the first side member includes a first connection member receiving slot formed therein;

wherein the second side member includes a second connection member receiving slot formed therein; and wherein the connection members on the first end and the second end of the lateral support member are configured to mate with the first connection member receiving slot and the second connection member receiving slot to connect the lateral support member to the first side member and the second side member.

11. The collapsible bench according to claim 10 further comprising a plurality of fasteners comprising the following:

a first fastener configured to extend through a portion of the first side member and into the bottom member;

a second fastener configured to extend through another portion of the first side member and into the bottom member;

a third fastener that is configured to extend through the second side member and into the bottom member;

a fourth fastener that is configured to extend through the second side member and into the lateral support member; and a fifth fastener that is configured to extend through the lateral support member and into the top member.

12. The collapsible bench according to claim 10 wherein each of the plurality of fasteners are threaded fasteners; and further comprising a respective plurality of fastener receiving members that are configured to threadably receive the respective plurality of fasteners.

13. The collapsible bench according to claim 10 further comprising floor contact members that are connected to bottom portions of the pair of legs of the first side member, the leg of the second side member, and the leg of the bottom member.

14. The collapsible bench according to claim 10 wherein the bench is movable between a collapsed position and an assembled position; and wherein when in the collapsed position, the bottom member, the first side member, the second side member and the lateral support member can be configured in a substantially flat configuration.

15. A collapsible bench kit comprising;

a container;

a collapsible bench that is moveable between an assembled position and a collapsed position, the collapsible bench comprising;

a bottom member having a leg extending downwardly from a bottom portion thereof;

a first side member that is detachably connectable to a first side portion of the bottom member;

a second side member that is detachably connectable to a second side portion of the bottom member;

a top member having a lateral support member fixedly connected thereto and extending downwardly from a bottom portion thereof, the lateral support member being detachably connectable to the first side member and the second side member;

a plurality of fasteners configured to connect the first side member to the bottom member and the lateral support member, and the second side member to the bottom member and the lateral support member;

wherein the assembled position is defined as the bottom member, the first side member, the second side member, the lateral support member and the top member being connected to one another to form an assembled bench; and wherein the collapsed position is defined as the bottom member, the first side member, the second side member, the lateral support member and the top member being detached from one another and configurable in a substantially flat configuration;

wherein when the collapsible bench is in the collapsed position, each of the bottom member, the first side member, the second side member, the lateral support member, the top member and the plurality of fasteners are positionable within the container.

16. The collapsible bench kit according to claim 15 wherein the first side member is defined by a top and a pair of legs that connect to and extend downwardly from the top; and wherein the pair of legs are sized to have a length so that a bottom of the pair of legs extends to a distance similar to a bottom of the leg that extends downwardly from the bottom member.

17. The collapsible bench kit according to claim 15 wherein the second side member is defined by a single leg that is sized to have a length so that a bottom of the single leg extends to a distance similar to a bottom of the leg that extends downwardly from the bottom member.

18. The collapsible bench kit according to claim 15 wherein the lateral support member is defined by a first end and a second end; wherein the first and second ends include connection members that extend outwardly therefrom; wherein the first side member includes a first connection member receiving slot formed therein; wherein the second side member includes a second connection member receiving slot formed therein; and wherein the connection members on the first end and the second end of the lateral support member are configured to mate with the first connection member receiving slot and the second connection member receiving slot to connect the lateral support member to the first side member and the second side member.

19. The collapsible bench kit according to claim 15 wherein the plurality of fasteners comprise:

a first fastener configured to extend through a portion of the first side member and into the bottom member;

a second fastener configured to extend through another portion of the first side member and into the bottom member;

a third fastener that is configured to extend through the second side member and into the bottom member; and a fourth fastener that is configured to extend through the second side member and into the lateral support member.

20. The collapsible bench kit according to claim 15 wherein the first side member is defined as having a pair of legs; wherein the second side member is defined by a single leg; and further comprising floor contact members that are connected to bottom portions of the pair of legs of the first side member, the leg of the second side member, and the leg of the bottom member.

* * * * *